US008208836B2

(12) United States Patent
Shimomura

(10) Patent No.: US 8,208,836 B2
(45) Date of Patent: Jun. 26, 2012

(54) DEVELOPER HOLDING APPARATUS, DEVELOPING APPARATUS, AND IMAGE FORMING APPARATUS

(75) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 672 days.

(21) Appl. No.: 12/318,324

(22) Filed: Dec. 24, 2008

(65) Prior Publication Data

US 2009/0185833 A1 Jul. 23, 2009

(30) Foreign Application Priority Data

Jan. 23, 2008 (JP) ..... 2008-012322

(51) Int. Cl.
*G03G 15/08* (2006.01)

(52) U.S. Cl. ..... 399/254

(58) Field of Classification Search ..... 399/254, 399/256, 263

See application file for complete search history.

(56) References Cited

U.S. PATENT DOCUMENTS 5,920,753 A * 7/1999 Sasaki et al. ..... 399/111
2006/0280526 A1* 12/2006 Shimomura ..... 399/258

FOREIGN PATENT DOCUMENTS

| | | |
|---|---|---|
| EP | 0 521 530 A | 1/1993 |
| JP | 61-138968 | 6/1986 |
| JP | 4-121765 | 4/1992 |
| JP | 11-024401 | 1/1999 |
| JP | 2000-35710 | 2/2000 |
| JP | 2001-42620 | 2/2001 |
| JP | 2002-108086 | 4/2002 |
| JP | 2004-198826 | 7/2004 |
| JP | 2005-250362 | 9/2005 |
| JP | 2006-39138 | 2/2006 |

* cited by examiner

*Primary Examiner* — David Gray
*Assistant Examiner* — Gregory H Curran
(74) *Attorney, Agent, or Firm* — Rabin & Berdo, P.C.

(57) ABSTRACT

A developer holding apparatus holds developer therein. The developer is discharged through a discharging opening. An agitator includes shaft portions and an agitating portion. A bearing member includes a bearing hole formed therein. One of the shaft portions is rotatably received in the bearing hole. The bearing hole has a larger diameter than the shaft portions. A hollow body is rotatable in the developer holding apparatus and the agitator rotates in the hollow body.

16 Claims, 14 Drawing Sheets

DEVELOPER HOLDING APPARATUS, DEVELOPING APPARATUS, AND IMAGE FORMING APPARATUS

BACKGROUND OF THE INVENTION

1. Field of the Invention

The present invention relates to the configuration of a developer holding apparatus attached to a developing apparatus. The developing apparatus is used in an image forming apparatus in which an electrostatic latent image is formed on an electrostatic latent image bearing body and is developed into a visible image.

2. Description of the Related Art

An electrophotographic image forming apparatus performs an electrophotographic image forming process: charging, exposing, developing, transferring, and fixing. An electrostatic latent image is formed on the charged surface of a photoconductive drum, and is then developed with toner into a toner image. The toner image is transferred onto print paper. The toner image is then fused into the print paper. The amount of toner in a developing unit decreases as printing is performed. Some image forming apparatuses are configured such that the toner cartridge may be replaced with a new, unused toner cartridge when the toner in the toner cartridge has been exhausted. The toner cartridge has a toner discharging opening formed therein. The toner cartridge is mounted to the developing unit, and then a shutter is opened to allow the toner to be discharged from the toner cartridge into a toner reservoir of the developing unit.

The toner may adhere to the inner surfaces of the walls of the toner cartridge or remain deposited on the bottom of the toner cartridge. Some toner cartridges include a toner agitator that agitates the toner during developing, thereby minimizing the amount of toner remaining unused in the toner cartridge. Other toner cartridges include a toner agitator and a resilient film attached to the toner agitator or the inner walls of the toner agitator, thereby further reducing the amount of toner that remains unused in the toner cartridge.

Still other cartridges include a bar-shaped toner agitator to which a resilient film is attached. The resilient film scrapes the inner walls of the toner cartridge to scrape the toner remaining unused on the inner walls. Conventional toner cartridges tend to impair print quality.

SUMMARY OF THE INVENTION

An object of the embodiments of the present invention is to improve the quality of printed images.

A developer holding apparatus holds a developer therein. The developer is discharged through a discharging opening. An agitator includes shaft portions and an agitating portion. A bearing member includes a bearing hole formed therein. One of the shaft portions is rotatably received in the bearing hole. The bearing hole has a larger diameter than the shaft portions. A hollow body is rotatable in the developer holding apparatus and the agitator rotates in the hollow body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
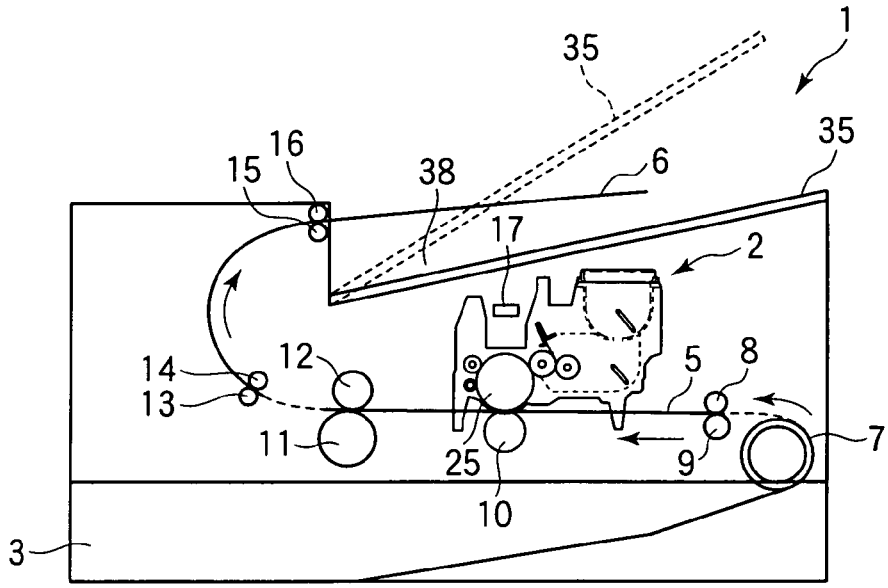
FIG. 1 illustrates the general configuration of an image forming apparatus of a first embodiment.

FIG. 1 illustrates a general configuration of an image forming apparatus 1 of a first embodiment.

Referring to FIG. 1, the image forming apparatus 1 is an electrophotographic printer that prints, for example, a black (K) image. The image forming apparatus 1 includes a transport path along which registry rollers 8 and 9 and discharging rollers 13-16 are disposed. A paper cassette 3 is located at a most upstream of the transport path, and holds a stack of recording paper 5. A stacker 38 is located at a most downstream of the transport path, and is defined on an upper surface of the image forming apparatus 1.

The paper cassette 3 holds a stack of recording paper. A hopping roller 7 feeds the top sheet of the recording paper 5 into the transport path. Registry rollers 8 and 9 are disposed downstream of the hopping roller 7, and correct the skew of the recording paper 5 before further transporting the recording paper 5 at predetermined timing. A developing unit 2 is disposed downstream of the registry rollers 8 and 9. The developing unit 2 includes a photoconductive drum 25 on which a toner image is formed. A transfer roller 10 extends in parallel to the photoconductive drum 25. When the recording paper 5 advances through the developing unit 2, the recording paper 5 is held in sandwiched relation so that the toner image is transferred onto the recording paper 5. A fixing unit is disposed downstream of the developing unit 2, and includes a heat roller 12 and a backup roller 11 that define a fixing point therebetween. When the recording paper 5 carrying the toner image thereon passes through the fixing point, the toner image is fused by heat and pressure. After fixing, the recording paper 5 is further transported by the discharging rollers 13-16.

Figure 2:
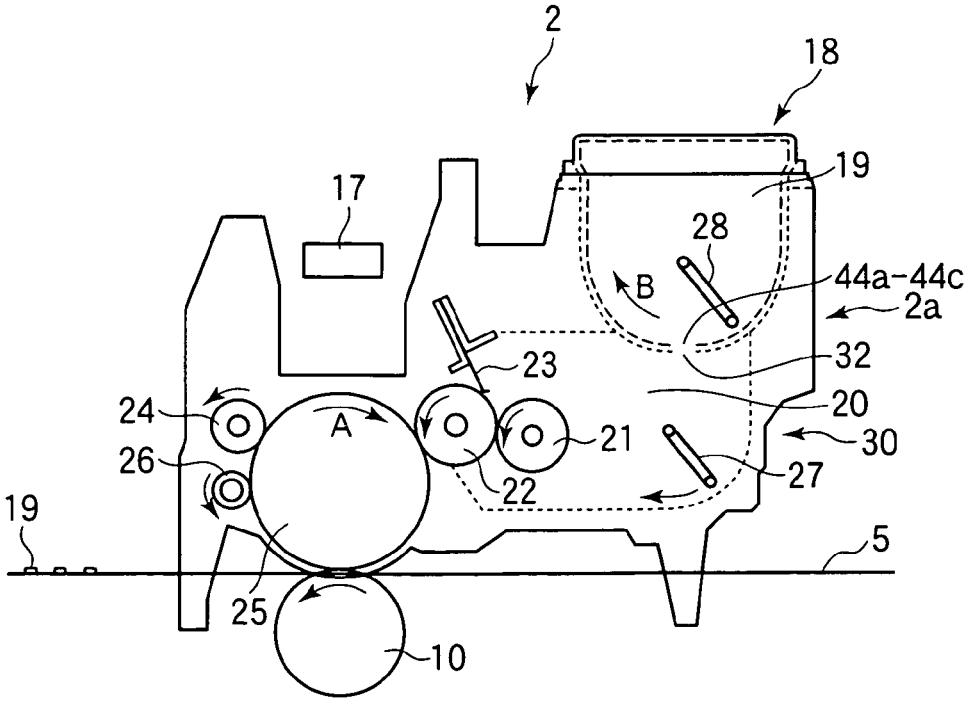
FIG. 2 illustrates a transfer roller, an LED head, recording paper, and a developing unit.

FIG. 2 illustrates the transfer roller 10, an LED head 17, the recording paper 5, and the developing unit 2.

Referring to FIG. 2, the photoconductive drum 25 is rotatable in a direction shown by arrow A. A charging roller 24, the LED head 17, a developing roller 22, the transfer roller 10, and a cleaning roller 26 are disposed around the photoconductive drum 25 in this order. The rotation of the photoconductive drum 25 is transmitted to the developing roller 22 via gears (not shown). Likewise, the rotation of developing roller 22 is transmitted to the toner supplying roller 21 via gears (not shown). The rotation of the toner supplying roller 21 is transmitted to an agitator 28. The gear that drives the agitator 28 in rotation is coupled to a gear 120 (FIG. 10) when a toner cartridge 18 is attached to the developing unit 2, so that the agitator 28 may be driven in rotation in a direction shown by arrow B. The charging roller 24 is in pressure contact with the surface of the photoconductive drum 25 and supplies charges to the photoconductive drum 25. The LED head 17 is disposed on the image forming apparatus 1 (FIG. 1) side, and illuminates the charged surface of the photoconductive drum 25 in accordance with image data to form an electrostatic latent image on the photoconductive drum 25.

A developing section 30 is disposed downstream of the LED head 17 with respect to rotation of the photoconductive drum 25. The developing section 30 supplies a developer or toner of a predetermined color (here black) to the electrostatic latent image formed on the photoconductive drum 25 to develop the electrostatic latent image into a toner image. The toner image is then transferred by a transfer roller 10 onto the recording paper 5. A cleaning roller 26 is disposed downstream of the developing section 30, and removes residual toner that remains on the photoconductive drum 25 after transfer of the toner image onto the recording paper 5.

The developing section 30 includes a toner reservoir 20, the agitators 27, the toner supplying roller 21, the developing roller 22, and the developing blade 23. The toner cartridge 18 is attached on the developing section 30, and includes the agitator 28 that agitates the developer in the toner cartridge 18 and guides the toner to discharging openings 44*a*-44*c*. The toner reservoir 20 holds the toner supplied from the toner cartridge 18. The agitator 27 in the developing section 30 agitates the toner in the toner reservoir 20, and supplies the toner to the toner supplying roller 21. The toner supplying roller 21 supplies the toner to the developing roller 22. The developing roller 22 is in pressure contact with the photoconductive drum 25, and supplies the toner to the photoconductive drum 25 to develop the electrostatic latent image into the toner image. The developing blade 23 is in pressure contact with the developing roller 22 to form a uniform, thin layer of toner on the developing roller 22.

The toner cartridge 18 is detachably attached on the developing unit 2 over the toner reservoir 20. When the toner cartridge 18 has been attached on the developing unit 2, the discharging openings 44*a*-44*c* are aligned with a toner replenishing opening 32 formed in the developing unit 2. The toner cartridge 18 may be formed in one piece with the developing unit 2.

A description will be given of how a drive force is transmitted from a drive source to the respective structural elements.

The photoconductive drum 25 includes a drum gear (not shown) in mesh with a gear (not shown) on the image forming apparatus 1 side such that the drive force is transmitted from the drive source via these gears. The photoconductive drum 25 is driven to rotate in a direction shown by an arrow. The developing roller 22 includes a gear in mesh with the drum gear, and is driven in rotation in a direction shown by an arrow. The toner supplying roller 21 also includes a gear (not shown). The gear of the developing roller and the gear of the toner supplying roller 21 are coupled via an idle gear, so that the developing roller and toner supplying roller 21 rotate in the same direction. The gear of the toner supplying roller 21 is in mesh with a gear (not shown) that drives the agitator 27 in rotation. When the toner cartridge 18 is attached to the developing unit 2, the gear that drives the agitator 27 is brought into meshing engagement with a gear 120 (FIG. 10) so that the agitator 28 rotates in a direction shown by arrow C.

Referring to FIGS. 1 and 2, the transfer roller 10 faces the photoconductive drum 25 of the developing unit 2. The transfer roller 10 is formed of an electrically conductive rubber material, and is urged against the photoconductive drum 25 with a transfer belt (not shown) sandwiched between the transfer roller 10 and the photoconductive drum 25. The transfer belt carries the recording paper 5 thereon, the recording paper 5 being electrostatically attracted to the transfer belt. A high voltage is applied to the transfer roller 10 to develop a potential difference between the surface of the photoconductive drum 25 and the surface of the transfer roller 10, the potential difference effectively transferring the toner image onto the recording paper 5.

An upper cover 35 of the image forming apparatus 1 is configured to open and close as illustrated in dotted lines. The developing unit 2 is detachably attached to the image forming apparatus 1. Likewise, the toner cartridge 18 is detachably attached to the body 2*a* of the developing unit 2.

Figure 3:
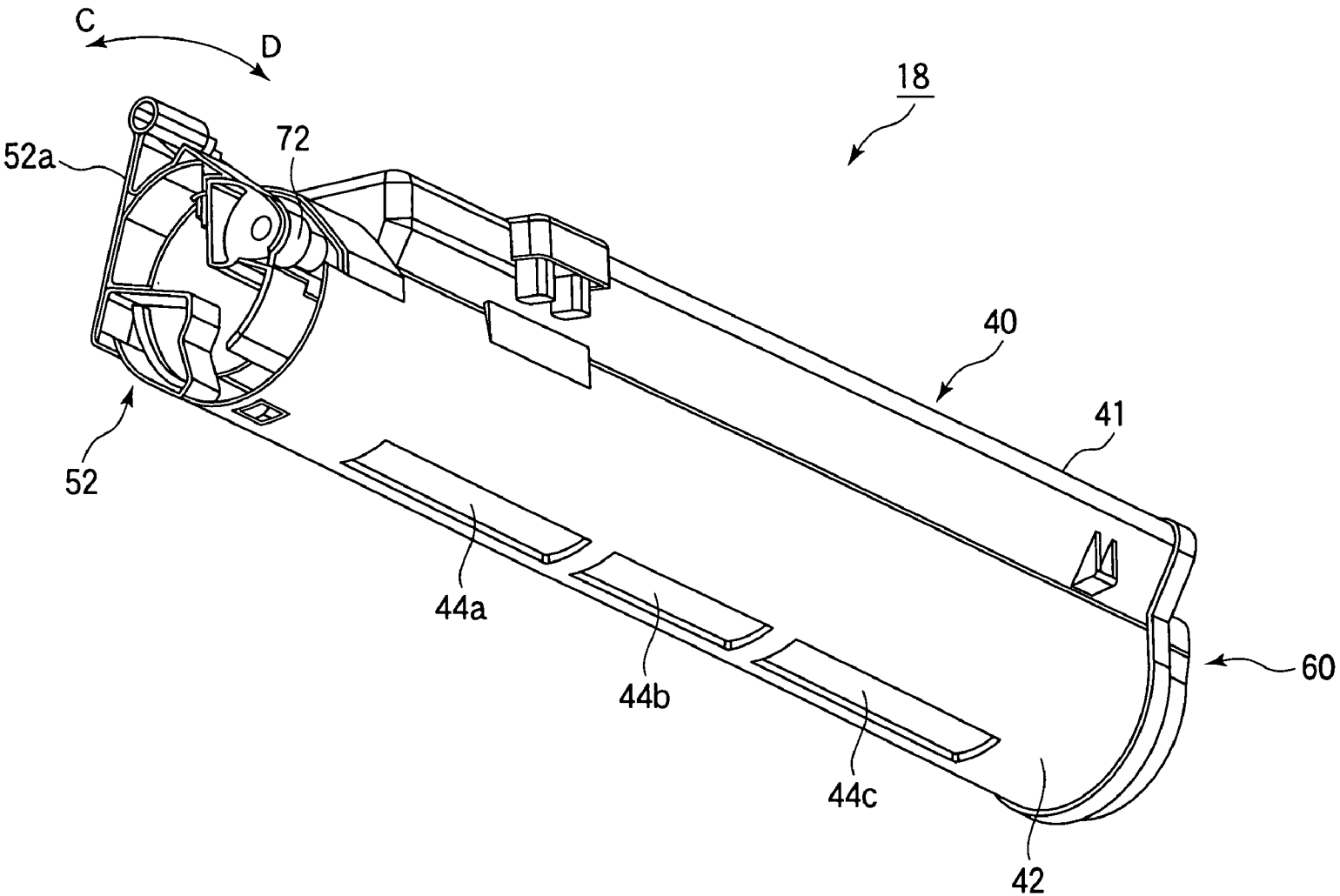
FIG. 3 is a perspective view of a toner cartridge as seen obliquely upward.
Figure 4:
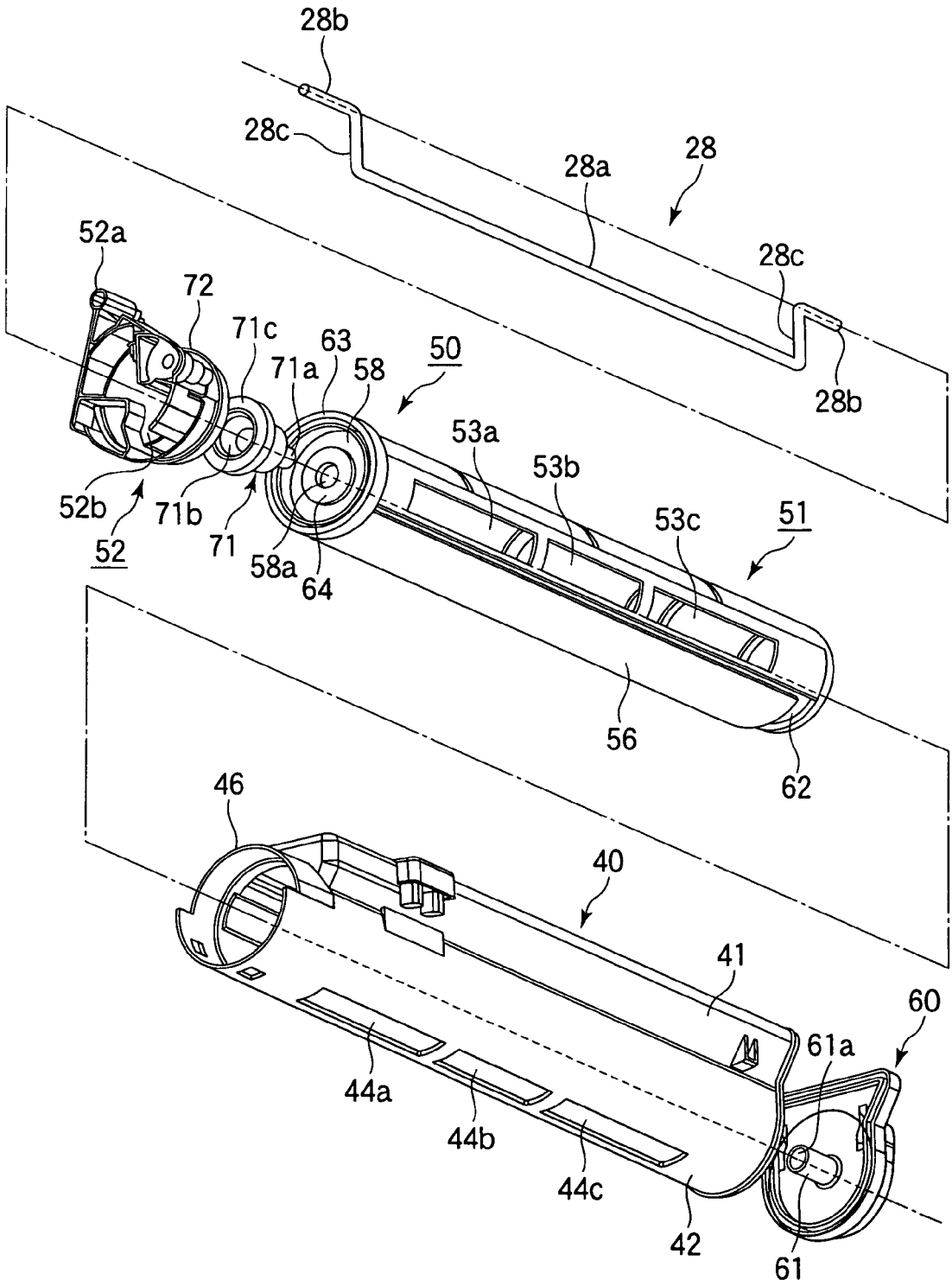
FIG. 4 is an exploded perspective view of the toner cartridge as seen in the same direction as FIG. 3.

FIG. 3 is a perspective view of the toner cartridge 18 as seen obliquely upward. FIG. 4 is an exploded perspective view of the toner cartridge 18 as seen in the same direction as FIG. 3. Referring to FIGS. 3 and 4, the toner cartridge 18 includes an outer hollow body 40, an inner hollow body 50, the agitator 28, and a side wall 60.

Referring to FIG. 3, the outer hollow body 40 includes a generally polygonal portion 41 and a generally cylindrical portion 42. The generally polygonal portion 41 and generally cylindrical portion 42 cooperate with each other to define a toner chamber that holds the fresh toner therein. The outer hollow body 40 extends in a longitudinal direction, and opens at its one longitudinal end. A side wall 60 is fixed to the longitudinal end to close the opening by, for example, welding. A bearing 61 is formed on the side wall 60, rotatably supporting a shaft portion 28*b* formed at one longitudinal end of the agitator 28. Discharging openings 44*a*-44*c* are formed in the bottom of the cylindrical portion 41 of the outer hollow body 40, being aligned in the longitudinal direction. The fresh toner is discharged from the toner chamber through the discharging openings 44*a*-44*c*.

The inner hollow body 50 is generally in the shape of a hollow cylinder, and includes a lever 52 and a shutter 51. The lever 52 includes a drive force transmitting mechanism for driving the agitator 28 to rotate. When the lever 52 is pivoted, the shutter 51 rotates relative to the cylindrical portion 42. The shutter 51 is received in the cylindrical portion 42, and the lever 52 is exposed on the outside of the outer hollow body 40. A rectangular loop-shaped sealing member 62 seals the gap between the inner hollow body 50 and the outer hollow body 40 against the environment. When an operator operates the lever 52 in directions shown by arrows C and D, the shutter 51 rotates such that the shutter 51 slides on the inner surface of the wall of the cylindrical portion 42 of the outer hollow body 40.

Figure 5:
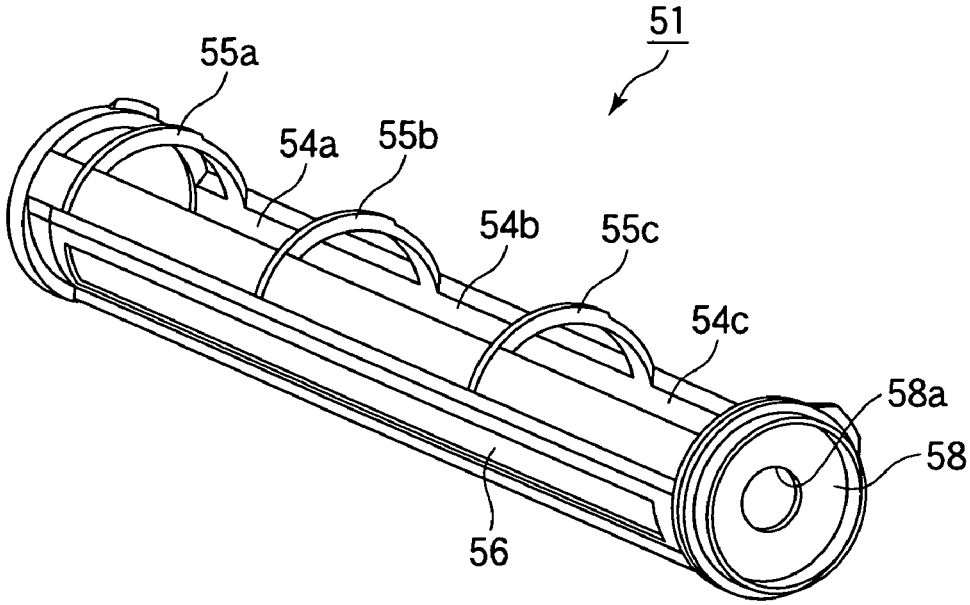
FIG. 5 is a perspective view as seen in a different direction from FIG. 4.

When the lever 52 is moved completely in the D direction, the discharging openings 53*a*-53*c* formed in the bottom of the cylindrical portion of the shutter 51 are aligned with receiving openings 44*a*-44*c* formed in the bottom of the outer hollow body 40. Upper openings 54*a*-54*c* (FIG. 5) are formed in the shutter 51 so that the fresh toner is directed from the polygonal portion 41 into the shutter 51. A plurality of ribs 55*a*-55*c* extend over the upper opening 54 to describe an arc, thereby cooperating with the rest of the shutter 51 to form generally short cylindrical walls of the shutter 51. FIG. 5 is a perspective view as seen in a different direction from FIG. 4. When the shutter 51 is oriented in the generally cylindrical portion 42 as shown in FIG. 4, the toner is discharged from the toner cartridge 18 into the developing unit 2 through the discharging openings 44*a*-44*c*.

The rectangular loop-shaped sealing member 62 is attached to an outer circumferential surface 56 of the shutter 51. The sealing member 62 includes an inner perimeter in which the discharging openings 44*a*-44*c* are located. When the lever 52 is moved completely in the C direction, the outer circumferential surface 56 closes the discharging openings 44*a*-44*c*, and the sealing member 62 seals the gap between the shutter 51 and the wall of the cylindrical portion 42 that defines the discharging openings 44*a*-44*c*. Thus, there is no possibility of the toner leaking from the toner cartridge 18. The shutter 51 includes a side wall 58 formed at its one longitudinal end farthest from the lever 52, and a hole 58*a* formed in the center of the side wall 58. The hole 58*a* receives a later described bearing member 71.

Figure 6:
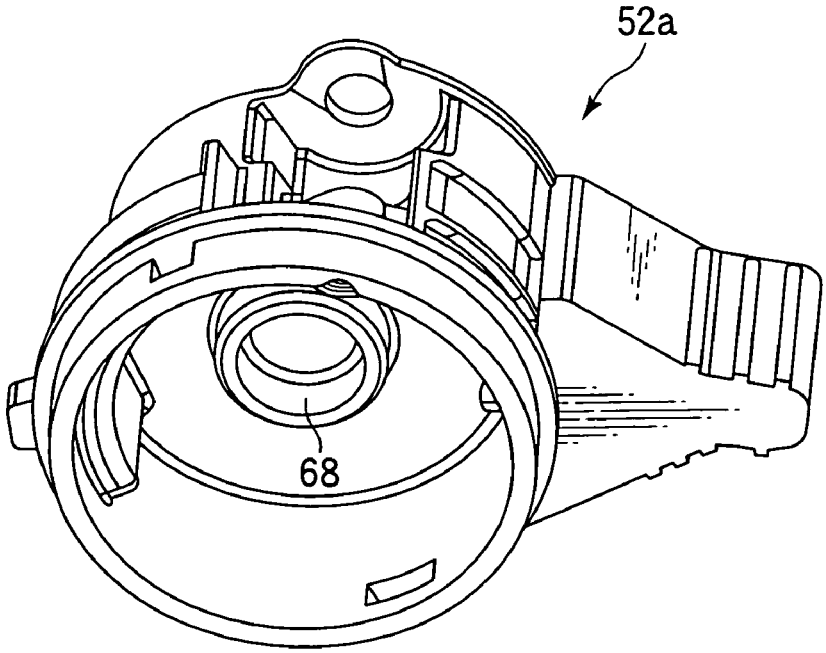
FIG. 6 is an enlarged perspective view of an agitator and an outer hollow body.

Referring to FIG. 4, the lever 52 includes a body 52*a*, an idle gear 72, and the bearing member 71. The idle gear 72 is journaled on the body 52*a*. The bearing member 71 is rotatably supported between the body 52*a* and the shutter 51. FIG. 6 is an enlarged perspective view of the body 52*a* of the lever 52.

The bearing member 71 has a hollow projection 71*a* (e.g., hollow cylinder) that projects from one side of the bearing member 71, and a bearing hole 71*b* formed in the other side of the bearing member 71. The hollow projection 71*a* is rotatably received in the hole 58*a* of the shutter 51, and a post 68 formed in the operation portion 52*a* extends into the bearing hole 71*b*, so that the bearing member 71 is rotatable on the post 68. The post 68 is received in the bearing hole 71*b* so that the bearing member 71 is rotatable on the post 68. The bearing member 71 includes a gear 71*c* formed in its circumferential surface, the gear 71*c* meshing with the idle gear 72. Thus, the bearing member 71 is rotatably received in the operation portion 52*a*, so that when the gear 71*c* is driven in rotation by the idle gear 72, the bearing member 71 rotates on the post 68. A sealing member 64 is sandwiched between the side wall 58 and the bearing member 71, sealing the gap between the side wall 58 and the bearing member 71 so that the toner will not leak from the shutter 51 to the inner space of the operation portion 52*a*.

The hollow projection 71*a* extends in a longitudinal direction of the shutter 51 through the hole 58*a* into the space within the shutter 51. The hollow projection 71*a* cooperates with the bearing 61 formed on the side wall 60 to rotatably support the shaft portions 28*b* (FIG. 4) of the agitator 28.

Figure 7A:
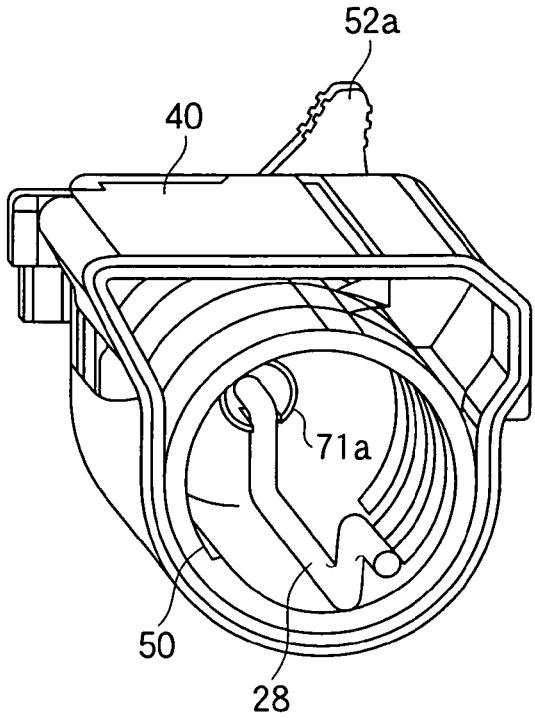
FIG. 7A is a partial perspective view of the agitator and a hollow projection in a shutter.
Figure 7B:
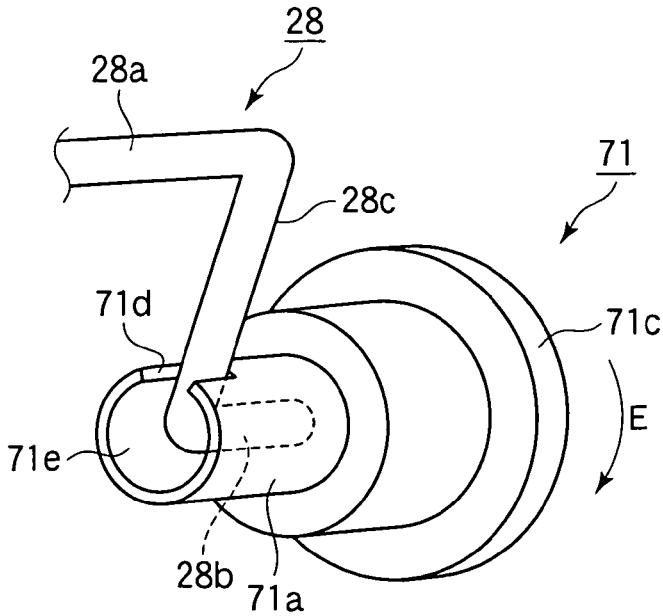
FIG. 7B illustrates the positional relation between the hollow projection and the agitator.

FIG. 7A is a partial perspective view of the agitator 28 and the hollow projection 71*a* in the shutter 51. FIG. 7B illustrates the positional relation between the hollow projection 71*a* and the agitator 28.

Referring to FIG. 7B, the agitator 28 is formed of a round bar shaped into a crank, and includes an agitating portion 28*a*, shaft portions 28*b*, and arm portions 28*c*. The agitator 28 rotates about the shaft portions 28*b*. The arm portions 28*c* extend in a direction at an angle (e.g., substantially perpendicular to) with the rotational axis of the agitator 28. The agitating portion 28*a* is connected to the arm portions 28*c* and extends in a direction substantially parallel to the shaft portions 28*b*. The hollow projection 71*a* includes a cylindrical wall defining a bearing hole or a cylindrical space 71*e*, and an abutment portion that defines a perimeter of a cutout 71*d* formed in the cylindrical wall. The bearing hole 71*e* receives one of the shaft portions 28*b* of the agitator 28 while the cutout 71*d* loosely receives one of the arms 28*c* of the agitator 28. The cutout 71*d* is wide enough for the arm 28*c* to be guided smoothly.

Another shaft portion 28*b* of the agitator 28 is rotatably received in a bearing hole 61*a* of the bearing 61 (FIG. 4) formed on the side wall 60. The bearing hole 71*e* and the bearing hole 61*a* have substantially the same diameter and are in line with the longitudinal axis of the shutter 51 and the rotational axis of the agitator 28.

When the idle gear 72 is driven in rotation by an external drive force, the drive force is transmitted to the bearing member 71 via the idle gear 72. The bearing member 71 rotates in a direction shown by arrow E (FIG. 7B), so that the hollow projection 71*a* causes the agitator 28 to rotate in the E direction.

Figure 8:
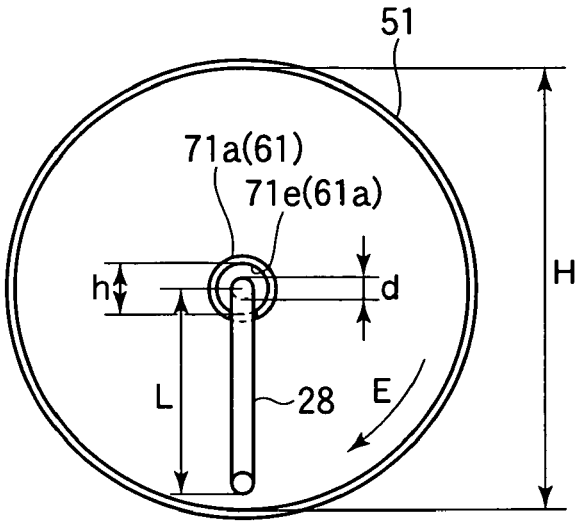
FIG. 8 illustrates the dimensional relationships among structural elements of the toner cartridge.

FIG. 8 illustrates the dimensional relationships among structural elements of the toner cartridge 18 of the aforementioned configuration.

The dimensions of the respective parts of the toner cartridge 18 are related as follows:

$$\{(H/2)-(h/2)\}<\{L-(d/2)\} \quad (1)$$

$$\{L+(d/2)\}<\{(H/2)+(h/2)\} \quad (2)$$

where L is the distance between the rotational axis of the agitator 28 and the surface of the agitating portion that is farthest from the rotational axis of the shaft portions 28*b* (i.e., L is a largest radius of a cylindrical space described by the agitator 28 when the agitator 28 rotates about the shaft portion 28*b*.

d is the diameter of the shaft portion 28*b*;

H is the inner diameter of the shutter 51; and h is the inner diameter of the bearing hole 61*a* and the bearing hole 71*e*.

It is to be noted that the bearing hole 61*a* and the bearing hole 71*e* have substantially the same diameter "h" and larger than the diameter "d" of the shaft portions 28*b*.

Meeting the conditions given by equations (1) and (2) allows the agitator 28 to rotate smoothly without damaging the inner surface of the wall of the shutter 51 or being damaged by the inner surface, so that the toner may be agitated efficiently.

Figure 9A:
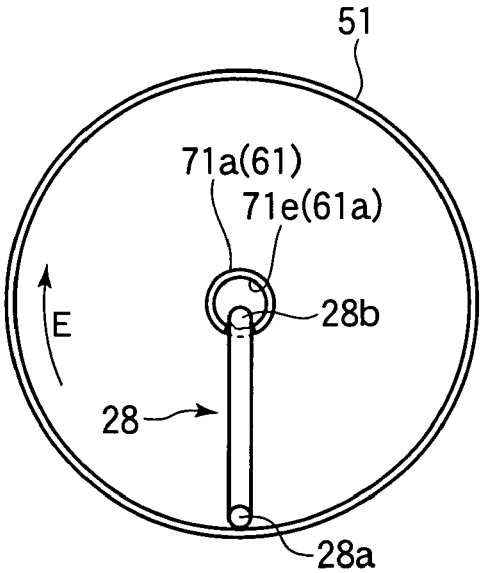
FIGS. 9A and 9B illustrate the positional relationship between the agitator, the shutter, and a bearing member.
Figure 9B:
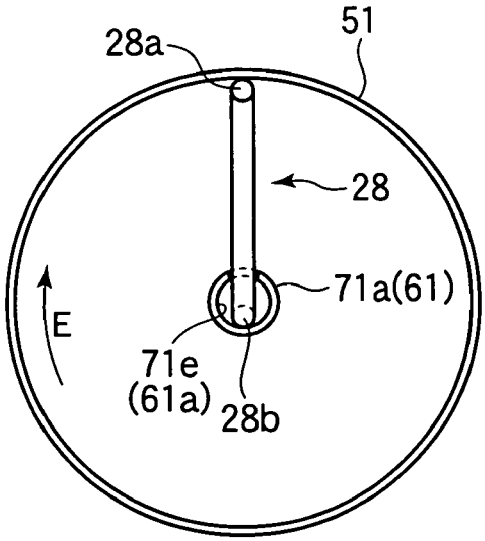

FIGS. 9A and 9B illustrate the positional relationship between the agitator 28, shutter 51, and bearing holes 71*e* and 61*a*.

Equation (1) must be satisfied when the agitator 28 takes the position shown in FIG. 9A in which the shaft portions 28*b* are in contact with the lowest surface of the wall that defines the bearing hole 71*e* of the hollow projection 71*a* and the lowest surface of the wall that defines the bearing hole 61*a*, and the agitating portion 28*a* is at its bottom dead center (i.e., lowest rotational position of the agitating portion 28*a*).

Equation (2) must be satisfied when the agitator 28 takes the position shown in FIG. 9B, in which the shaft portions 28*b* are in contact with the lowest surface of the wall that defines the bearing hole 71*e* of the hollow projection 71*a* and the lowest surface of the wall that defines bearing hole 61*a* of the bearing 61, and the agitating portion 28*a* is at its top dead center (i.e., highest rotational position of the agitating portion 28*a*) of the agitator 28. At the FIG. 9B position, the agitating portion 28*a* does not contact the inner surface of the shutter 51.

The toner cartridge 18 of the aforementioned configuration is attached to the body 2*a* of the developing unit 2. The operation of the agitator 28 during printing will be described.

Figure 10:
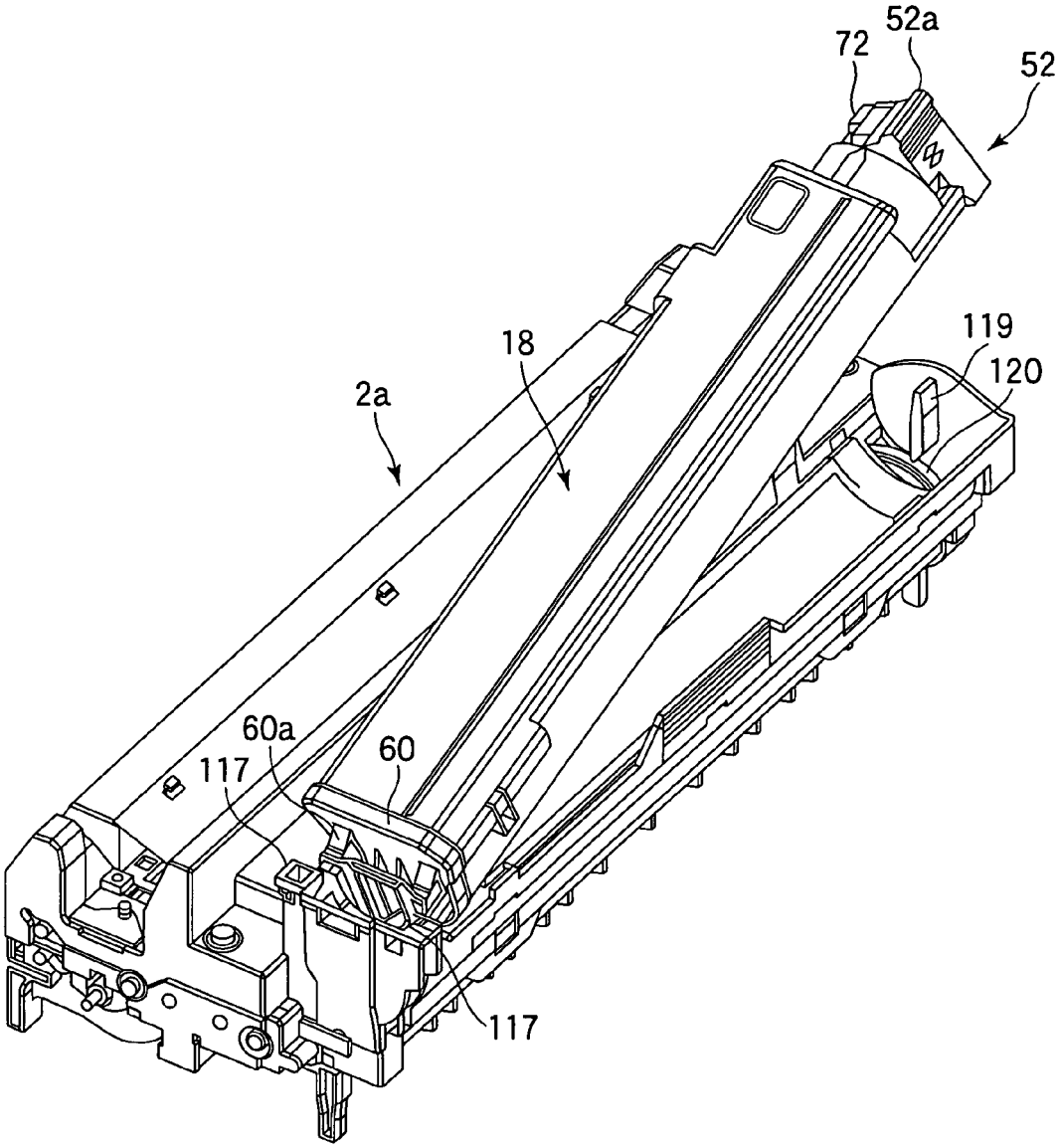
FIG. 10 illustrates the operation when the toner cartridge is attached to the body of a developing unit.
Figure 11A:
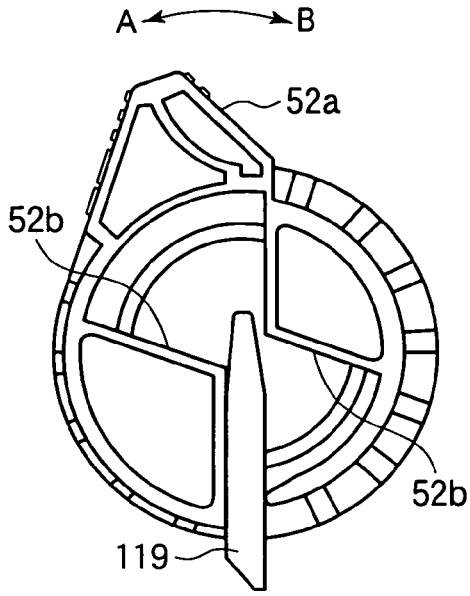
FIGS. 11A-11C illustrate how a rib enters the space defined by the guides when the toner cartridge is lowered into the body.
Figure 11B:
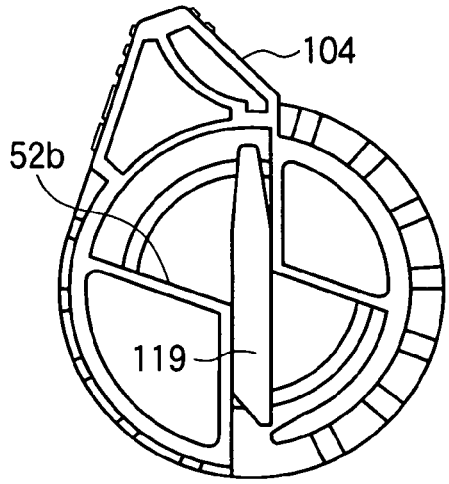
Figure 11C:
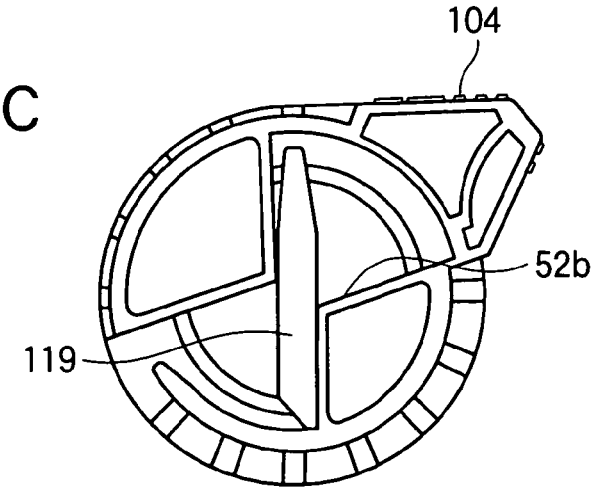

FIG. 10 illustrates the operation when the toner cartridge 18 is attached to the body 2*a* of the developing unit 2. Referring to FIG. 10, the toner cartridge 18 is inserted into the body 2*a* such that an engagement portion 60*a* formed on the outer surface of the side wall 60 enters under a rib 117 of the body 2*a*. Then, the toner cartridge 18 is further inserted such that a rib 119 of the body 2*a* enters a space defined between guides 52*b* (FIG. 4) formed in the operation portion 52*a* of the toner cartridge 18. FIGS. 11A-11C illustrate how the rib 119 enters the space defined by the guides 52*b* when the toner cartridge 18 is lowered into the body 2*a*.

Before the toner cartridge 18 has been attached to the body 2*a*, the discharging openings 44*a*-44*c* is sealingly closed by the circumferential surface 56 of the shutter 51, and the operation portion 52*a* is at a position where the operation portion 52*a* has been completely rotated in the A direction (FIG. 3, FIGS. 11A-11C). As the toner cartridge 18 is lowered into the body 2*a*, the rib 119 slides on one of the guides 52*b* to enter the space defined between the guides 52*b* until the rib 119 takes up the FIG. 11B position where the rib 119 is completely received in the space between the guides 52*b*.

When the lever body 52*a* has been rotated completely in the D direction, the rib 119 has entered a locking engagement with the guides 52*b* as shown in FIG. 11C. Thus, the toner cartridge 18 is fixed to the body 2*a* and the discharging opening 44*a*-44*c* are opened to discharge the toner from the toner cartridge 18.

When the toner cartridge 18 has been attached to the body 2*a*, the idle gear 72 formed on the lever body 52*a* meshes with a drive gear 120 located on the body 2*a* side. Thus, the drive force is transmitted from the gear 120 to the bearing member 71 via the idle gear 72, causing the agitator 28 to rotate in the E direction (FIG. 7B).

If a sufficient amount of toner 19 remains in the toner cartridge 18, the agitator 28 rotates together with the bearing member 71 under a relatively large load exerted by the toner 19 and some toner that has entered the bearing hole 71*e* and the bearing hole 61*a*. During rotation, the shaft portions 28*b* rotate within the bearing hole 71*e* and the bearing hole 61*a* (FIG. 4), the shaft portions 28*b* being loosely received in the bearing holes 71*e* and 61*a*, the center of rotation of the shaft portions 28*b* moving little by little in the holes 71*e*.

The operation of the agitator 28 will be described with reference to FIGS. 12A-12F, FIG. 13A-13G, and FIG. 7B by way of the bearing member 71.

{When Toner Cartridge Holds Sufficient Amount of Toner}

FIGS. 12A-12F illustrate the locus of the agitator 28 rotating in the toner cartridge 18 when the toner cartridge 18 holds a sufficient amount of toner and some toner has entered the bearing hole 71*e*.

Figure 12A:
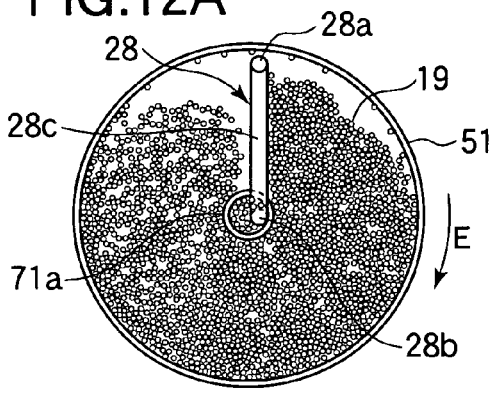
FIGS. 12A-12F illustrate the locus of the agitator rotating in the toner cartridge when the toner cartridge holds a sufficient amount of toner and some toner has entered a bearing hole.

FIG. 12A illustrates the agitator 28 rotating in the E direction and reaching its top dead center (highest rotational position of the agitator 28). A part of the bearing member 71 that defines the cutout 71*d* abuts the arm portion 28*c* of the agitator and pushes as the bearing member 71 to rotate. The agitator 28 rotates together with the bearing member 71 through an angle of 90 degrees to the FIG. 12B position, the shaft portions 28*b* being pressed downward against the lower surface of the wall that defines the bearing hole 71*e*.

Figure 12B:
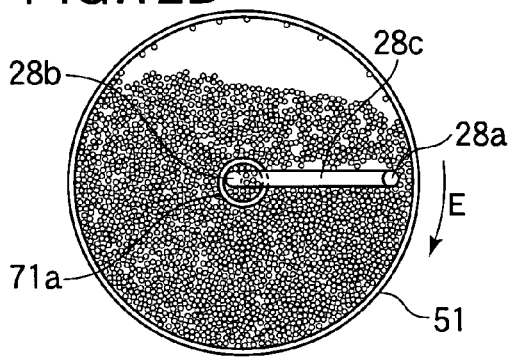
Figure 12C:
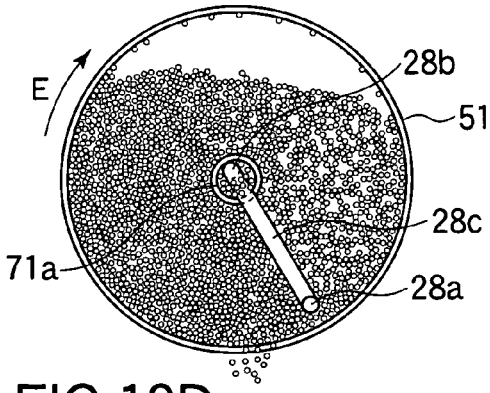
Figure 12F:
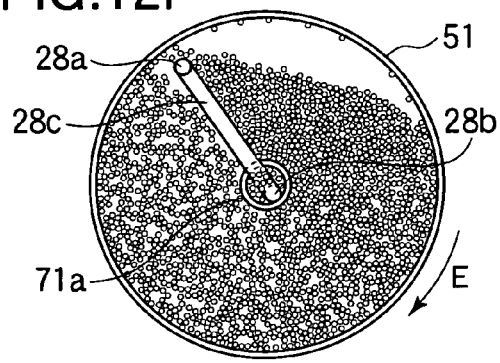
Figure 12D:
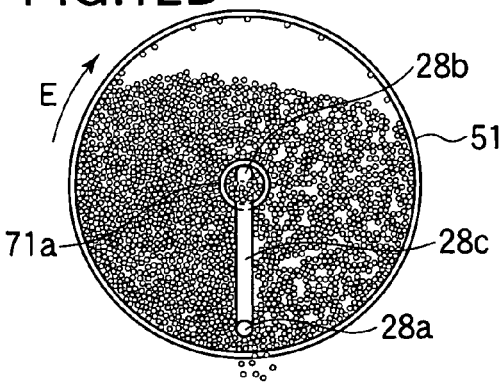
Figure 12E:
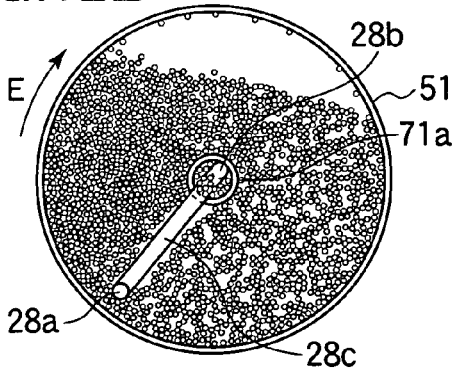

When the agitator 28 further rotates from the FIG. 12B position where the arms 28*c* extend substantially horizontally, to the FIG. 12C position, the shaft portion 28*b* is still pressed against the wall defining the bearing hole 71*e*, and rotates together with the bearing member 71 under a load exerted by the toner 19 and some toner that has entered the bearing hole 71*e*. The agitator 28 rotates substantially the same manner as in FIGS. 12B and 12C when the agitator 28 rotates through the positions shown in FIG. 12D-12F.

Although the shaft portions 28*b* press different parts of the inner surface of the wall that defines the bearing hole 71*e*, the agitating portion 28*a* do not contact the inner wall of the shutter 51.

{When Toner Cartridge Holds Small Amount of Toner}

FIGS. 13A-13G illustrate the locus of the agitator 28 rotating in the toner cartridge 18 when the toner cartridge 18 holds only a small amount of toner 19 and some toner has entered the bearing hole 71*e*. FIGS. 14A-14D are side views corresponding to FIGS. 13A-13D, respectively.

Referring to FIGS. 13A-13G, the agitator 28 rotates together with the bearing member 71 under a small load exerted by the toner 19, some toner that has entered the bearing hole 71*e*, and the gravitational force due to the weight (e.g., 5 to 15 grams) of the agitator 28. The bearing member 71 rotates at a speed (e.g., 20 to 60 rpm) such that no significant centrifugal force is exerted on the agitator 28.

Figure 13A:
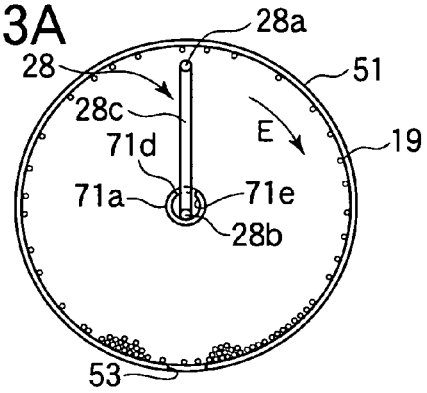
FIGS. 13A-13G illustrate the locus of the agitator rotating in the toner cartridge when the toner cartridge holds only a small amount of toner.

FIG. 13A illustrates the agitator 28 when the agitator 28 rotates in the E direction, reaching its top dead center (i.e., highest position). The agitator 28 rotates together with the bearing member 71 through an angle of approximately 90 degrees from the FIG. 13A position to the FIG. 13B position, the shaft portion 28*b* being pressed against the lower surface of the wall defining the bearing hole 71*e*.

Figure 13B:
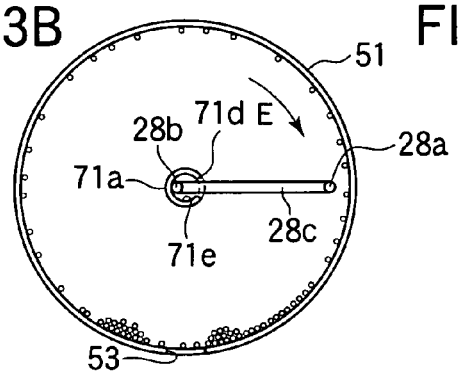
Figure 13G:
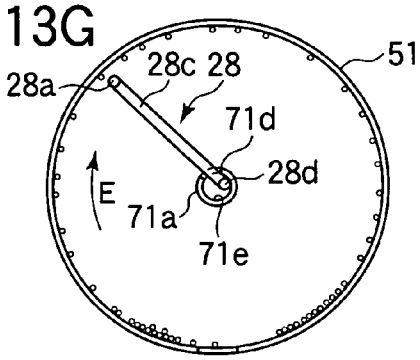

When the agitator 28 rotates past the FIG. 13B position where the arms 28*c* extend substantially horizontally, the shaft portion 28*b* slowly slides on the surface of the wall defining the bearing hole 71*e*. As the agitating portion 28*a* further rotates, the shaft portion 28*b* slides on the wall slowly approaching its bottom dead center (i.e., lowest rotational position of the agitator 28).

Figure 13C:
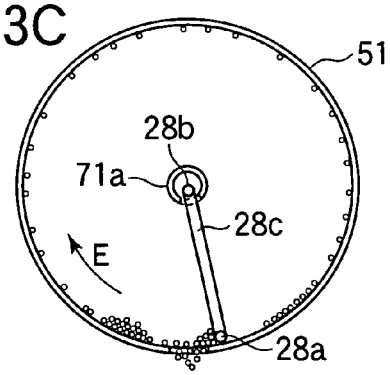
Figure 13F:
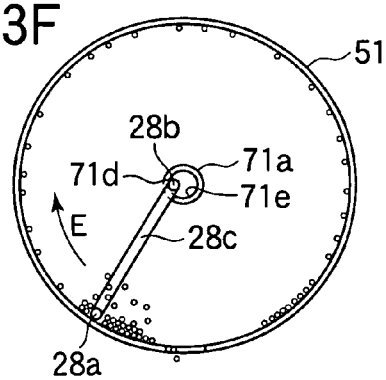
Figure 13D:
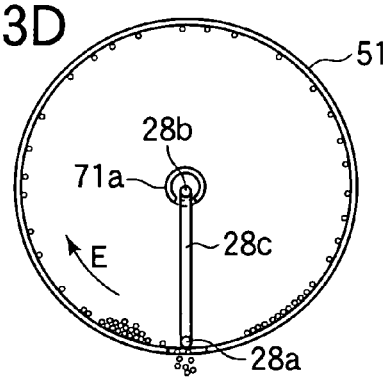

The agitator 28 further rotates past the FIG. 13C position reaching its bottom dead center (lowest rotational position of the agitator 28) as shown in FIG. 13D where the agitating portion 28*a* contacts the bottom surface of the wall of the shutter 51, the shaft portion 28*b* further slides on the wall defining the bearing hole 71*e*, arriving at its bottom dead center. Depending on the magnitude of the load exerted on the agitator 28, the agitating portion 28*a* rotates as shown in FIGS. 13E and 13F, the shaft portion 28*b* slides on the wall at slightly different positions from that shown in FIG. 13D.

Figure 13E:
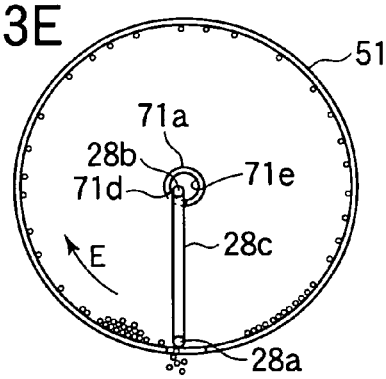

Because the bearing member 71 continues to rotate, the agitator 28 is pushed by the part of the bearing member 71 that defines the cutout 71*d*, rotating together with the bearing member 71 from the FIG. 13D position to the FIGS. 13E and 13F positions. When the agitating portion 28*a* rotates through a limited angular range including the FIG. 13D position, the agitating portion 28*a* is in contact with the surface of the wall of the shutter 51.

As the agitator 28 further continues to rotate so that the arms 28*c* extend substantially horizontally, the agitating portion 28*a* begins to leave the wall of the shutter 51. When the agitator 28 further rotates reaching the FIG. 13G position, the shaft portion 28*b* slides on the wall that defines the bearing hole 71*e*. The agitator 28 further rotates reaching its top dead center (highest rotational position of the agitating portion 28*a*) as shown in FIG. 13A. For each complete rotation of the agitator 28, the positions of agitating portion 28*a* and shaft 28*b* change as shown in FIGS. 13A-13G.

The locus of the agitator 28 may vary in accordance with the center of gravity of the agitator 28 and various factors that satisfy equations (1) and (2) including the dimensions of various structural elements, the width of the cutout 71*d* in a circumferential direction, and the remaining amount of toner that exerts a load on the agitator 28. However, as long as equation (1) is satisfied, the agitating portion 28*a* slides on the inner surface of the shutter 51 as shown in FIGS. 13C-13F. As long as equation (2) is satisfied, the agitator 28 is not caught tightly between the surface of wall of the shutter 51 and the surface of wall that defines the bearing hole 71*e*. Thus, smooth rotation of the agitator 28 is not impaired. The components of the structural elements are not damaged. No abnormally large load is exerted on the agitator 28.

Figure 14A:
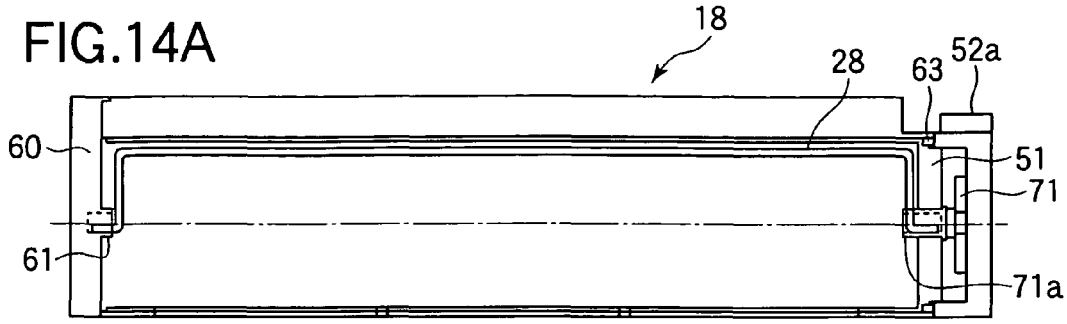
FIGS. 14A-14D are side views corresponding to FIGS. 13A-13D, respectively.
Figure 14B:
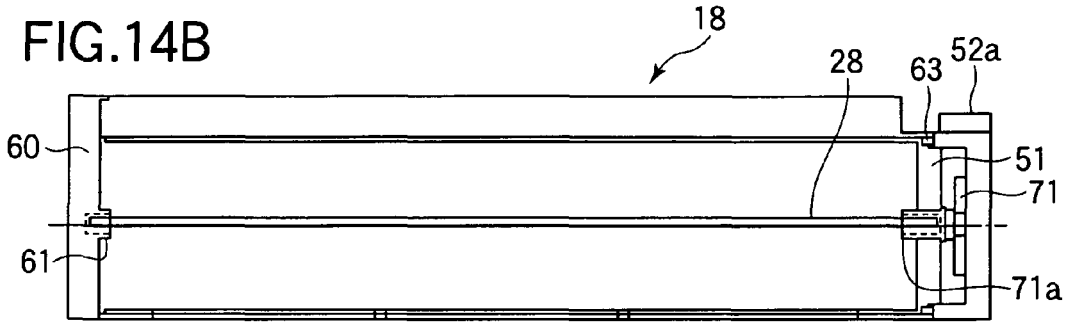
Figure 14C:
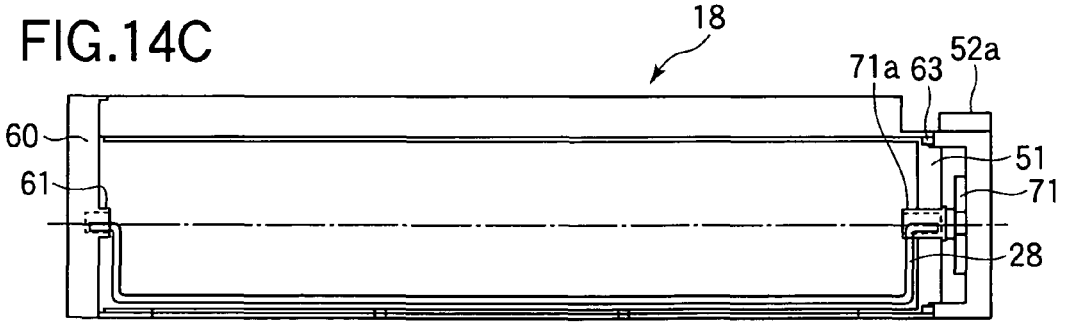
Figure 14D:
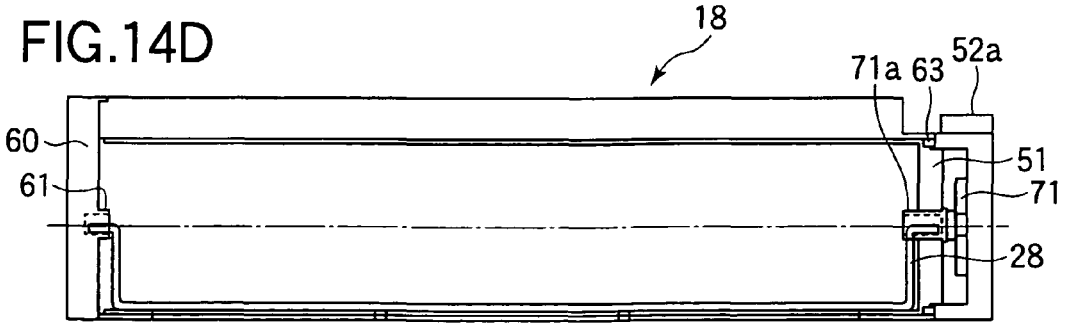

While the relationship between the cylindrical hollow portion 71*a* and the agitator 28 has been described with reference to FIGS. 13A-13G, the relationship is also true for the bearing portion 61 of the side wall 60 and the agitator 28 illustrated in FIGS. 14A-14D. In other words, as long as equation (1) is satisfied, the agitating portion 28*a* slides on the inner surface of the shutter 51 as the agitating portion 28*a* passes the vicinity of the inner bottom surface of the shutter 51, toward the bottom surface and away from the bottom surface as shown in FIGS. 14C-14D. As long as equation (2) is satisfied, the agitator 28 is not caught tightly between the surface of wall of the shutter 51 and the surface of wall that defines the bearing hole 61*a*. Thus, smooth rotation of the agitator 28 is not impaired. The components of the structural elements are not damaged. No abnormally large load is exerted on the agitator 28.

Figure 17:
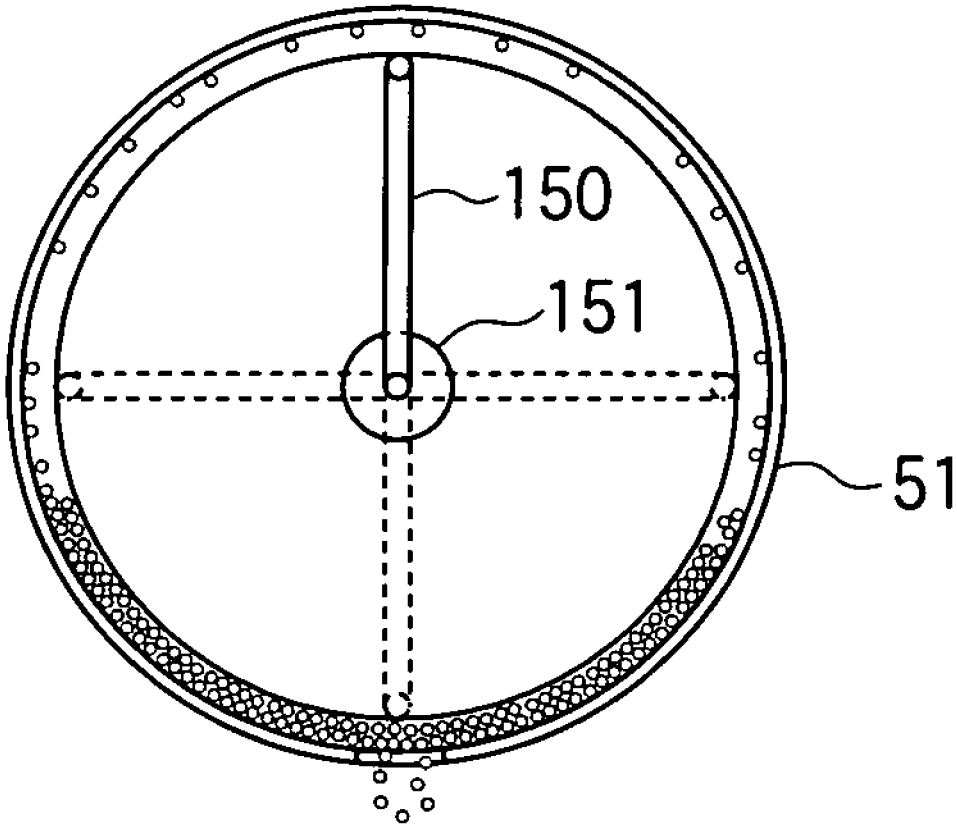
FIG.17 CONVENTIONAL ART
FIG. 17 compares a conventional toner cartridge with the toner cartridge of the first embodiment.

FIG. 17 compares a conventional toner cartridge with the toner cartridge 18 of the first embodiment. An agitator 150 is secured to a shaft 151. Therefore, the structure shown in FIG. 17 requires some clearance between the outermost locus of the agitator 150 and the inner wall of the shutter 51 so that the agitator 150 will not contact the inner surface of the wall of the shutter 51. When the agitator 150 passes through its bottom dead center, the agitator 150 does not contact with the inner wall of the shutter 51. Thus, an amount of unused toner tends to remain on the inner bottom surface of the shutter 51.

Conventional toner cartridges include a resilient member that scrapes the inner walls of the toner cartridge. Provision of a resilient member such as a film in a toner cartridge increases the number of components of the toner cartridge, and requires an additional assembly time. The film rotates while scraping the inner walls of the toner cartridge. Thus, a large load is exerted on the film. If a relatively small amount of toner remains in the toner cartridge, the toner may be agitated more than necessary, so that the external additive added to the surfaces of the toner particles may come off the surfaces of toner particles or berried in the toner particles. Such damage to the toner may cause fog or smear of printed images.

In contrast, the aforementioned configuration does not make the agitator 28 inoperative or cause any abnormally large load on the agitator 28. When the agitator portion 28*a* passes through the bottom dead center, the agitating portion 28*a* slides on the inner bottom surface of the shutter 51 to agitate or discharge the remaining toner, allowing the toner to be used up completely. When the toner cartridge holds a relatively large amount of toner therein, the agitator 28 does not contact the inner surface of the shutter 51, thus not rubbing the toner against the wall more than necessary as well as preventing the toner from being deteriorated.

Second Embodiment

A second embodiment differs from the first embodiment only in that a bearing member 171 is used. Elements similar to those of the first embodiment have been given the same reference numerals and their description is omitted.

Figure 15A:
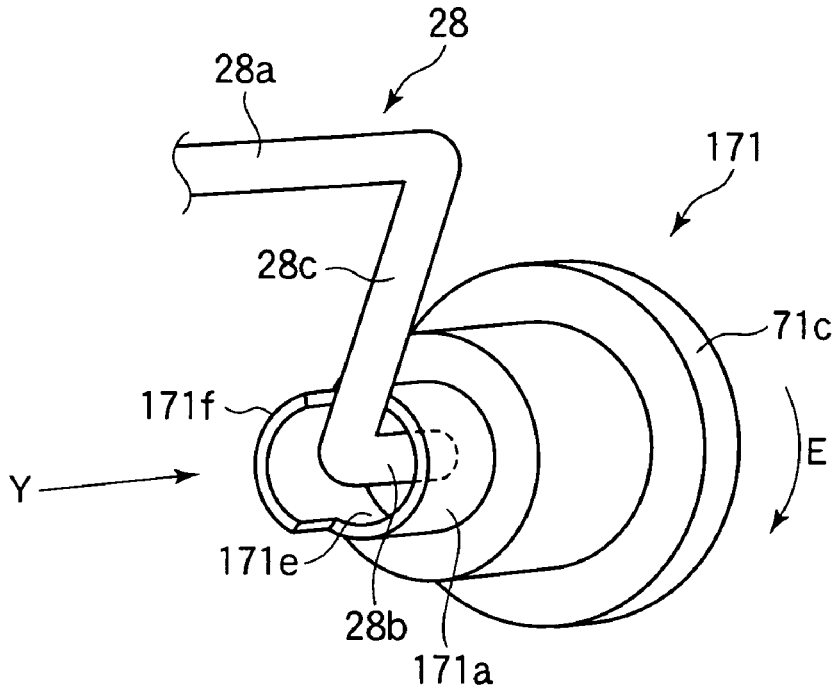
FIG. 15A is a perspective view of a cylindrical hollow portion of a bearing member and a part of an agitator of a second embodiment.
Figure 15B:
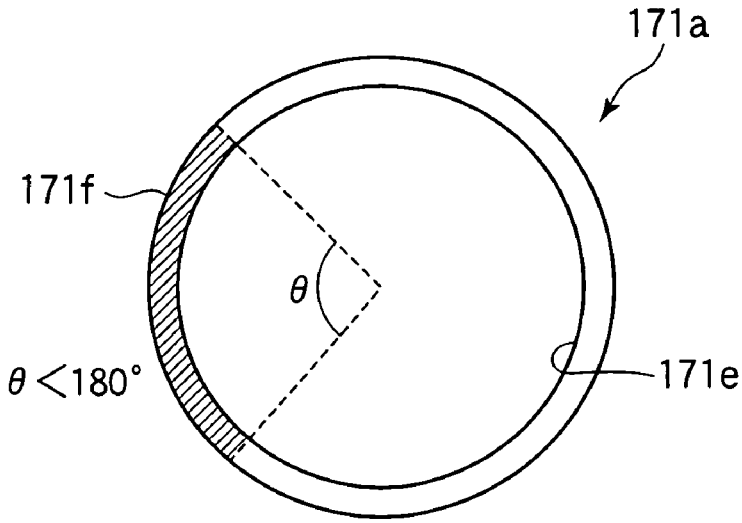
FIG. 15B is a view as seen in a direction shown by arrow Y of FIG. 15A.

FIG. 15A is a perspective view of a cylindrical hollow portion 171*a* of a bearing member 171 and a part of an agitator 28. FIG. 15B is a view as seen in a direction shown by arrow Y of FIG. 15A.

Referring to FIG. 15A, the cylindrical portion 171*a* includes a bearing hole 171*e* into which a shaft portion 28*b* of the agitator 28 is loosely received, and an abutment portion or a partially cylindrical wall 171*f* that extends from the cylindrical portion 171*a* in a direction parallel to the rotational axis of the agitator 28 and in a circumferential direction about the bearing hole 171*e* over an angle θ less than 180 degrees. The partially cylindrical wall 171*f* engages an arm 28*c* of the agitator 28 to transmit a drive force to the agitator 28.

Referring back to FIG. 8, the dimensions of the respective parts of the toner cartridge 18 are related as follows:

$$\{(H/2)-(h/2)\}<\{L-(d/2)\} \quad (1)$$

$$\{L+(d/2)\}<\{(H/2)+(h/2)\} \quad (2)$$

where L is the distance between the rotational axis of the agitator 28 and the surface of the agitating portion that is farthest from the rotational axis of the shaft portions 28*b* (i.e., L is a largest radius of a cylindrical space described by the agitator 28 when the agitator 28 rotates about the shaft portion 28*b*.

d is the diameter of the shaft portion 28*b;*

H is the inner diameter of the shutter 51; and h is the inner diameter of the bearing hole 61*a* and the bearing hole 171*e*.

It is to be noted that the bearing hole 61*a* and the bearing hole 71*e* have substantially the same diameter "h" and larger than the diameter "d" of the shaft portions 28*b*.

{When Toner Cartridge Holds Sufficient Amount of Toner}

The operation of the agitator 28 in the shutter 51 of the aforementioned configuration will be described.

If the toner cartridge 18 holds a sufficient amount of toner 19 therein, the agitator 28 rotates together with the bearing member 171 under a relatively large load exerted by the toner 19, and some toner enters the bearing hole 171*e* and the bearing hole 61*a*. During rotation, the shaft portions 28*b* rotate within the bearing hole 171*e* and the bearing hole 61*a* (FIG. 4), being loosely received in the bearing holes 171*e* and 61*a* as well as sliding on the surfaces of the walls that define the bearing hole 171*e* and bearing hole 61*a*. When the agitating portion 28*a* rotates past its bottom dead center (lowest position), the agitating portion 28*a* rotates not contacting the inner wall surface of the shutter 51.

{When Toner Cartridge Holds Small Amount of Toner}

FIGS. 16A-16G illustrate the locus of the agitator 28 when only a small amount of toner remains in the toner cartridge 18. No significant amount of toner remains in the bearing hole 171*e* and the bearing hole 61*a*, and less load is exerted on the agitator 28.

As the amount of toner remaining in the toner cartridge 18 becomes smaller, the movement of the agitator 28 is less dependent on the toner, so that the agitating portion 28*a* falls freely when it rotates past its top dead center (highest rotational position of the agitating portion 28*a*). When the amount of toner remaining in the toner cartridge 18 becomes sufficiently small, equation (1) is satisfied so that the agitating portion 28*a* collides with the surface of the wall of the shutter 51. This operation will be described in more detail as follows:

When the toner cartridge 18 holds a very small amount of toner, the force acting on the agitator 28 is the sum of the drive force exerted by the partially cylindrical wall 171*f* and the gravitational force due to the weight (e.g., 5 to 15 grams) of the agitator 28. The bearing member 71 rotates at a low speed (e.g., 20 to 60 rpm), so that no significant centrifugal force is exerted on the agitator 28.

Figure 16A:
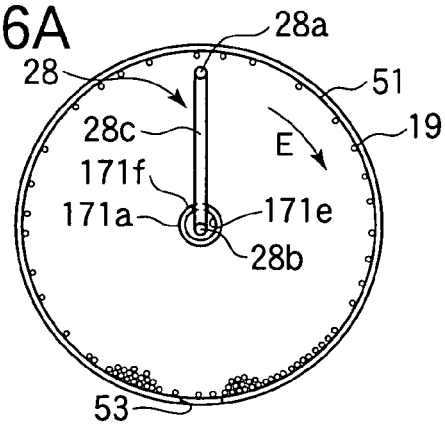
FIGS. 16A-16G illustrate the locus of the agitator when only a small amount of toner remains in the toner cartridge.

FIG. 16A illustrates the agitator 28 when the agitator 28 rotates in the E direction reaching its top dead center (highest rotational position of the agitating portion 28*a*). After the agitator 28 has passed the top dead center, the agitating portion 28*a* falls in the E direction due to its own weight. Because the partially cylindrical wall 171*f* extends in the circumferential direction over the angle θ less than 180 degrees (FIG. 15B), the agitating portion 28*a* is allowed to drop to the bottom dead center (lowest rotational position of the agitating portion 28*a*) without any obstruction.

Figure 16B:
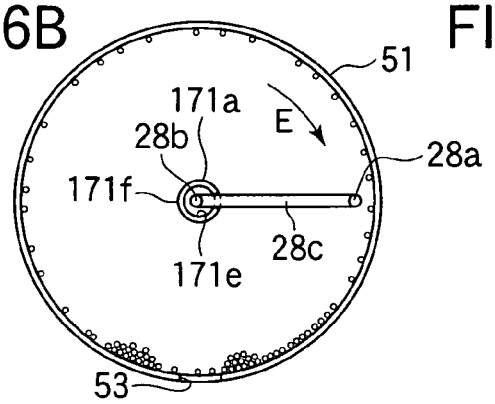
Figure 16G:
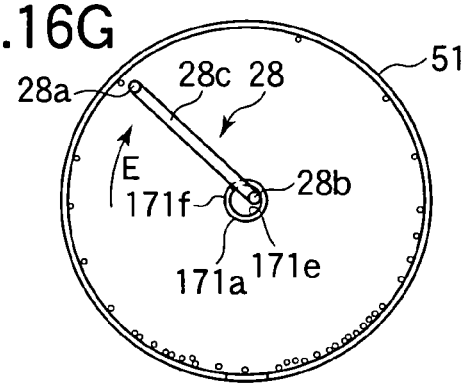
Figure 16C:
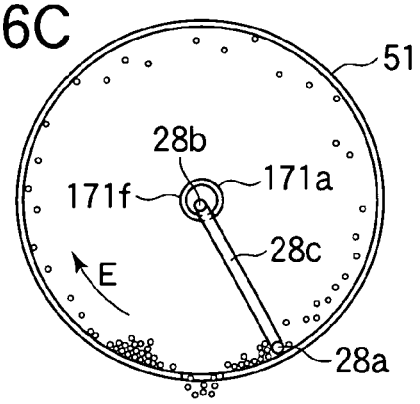

FIG. 16B illustrates the agitating portion 28*a* when it is dropping freely due to its weight. After falling by gravity, the agitating portion 28*a* collides with the inner surface of the wall of the shutter 51 near the bottom dead center, as is clear from equation (1). As is shown in FIG. 16C, the agitating portion 28*a* collides with the inner surface of the wall of the shutter 51 at a position upstream of the bottom dead center with respect to the rotation of the agitating portion 28*a*, relatively farther from the bottom dead center, if the distance L is selected to be a longer one of the values of the distance L that satisfy equations (1) and (2). The agitating portion 28*a* collides with the inner surface of the wall of the shutter 51 at a position upstream of the bottom dead center but closer to the bottom dead center with respect to the rotation of the agitating portion 28*a* if the distance L is selected to be a shorter one of the values of the distance L that satisfy equations (1) and (2). Due to the collision, the toner adhering to the inner surface of the wall of the outer hollow body 40 (FIG. 4) comes off. In other words, the distance L should be selected such that a maximum collision is obtained.

Figure 16F:
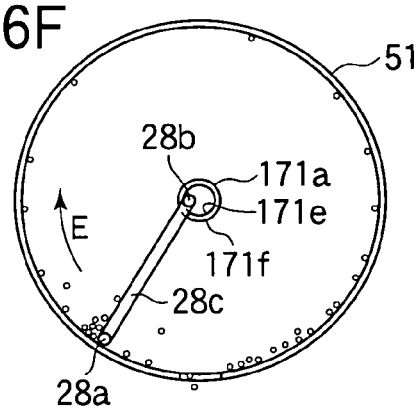
Figure 16D:
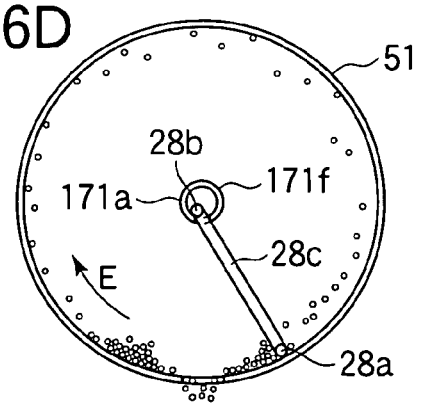
Figure 16E:
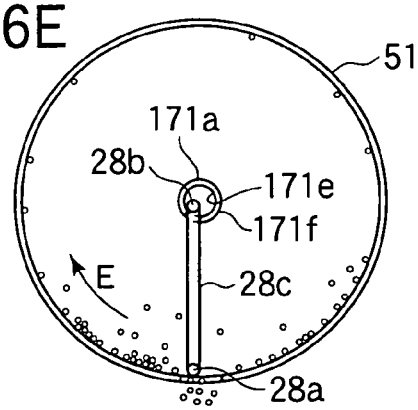

The bearing member 171 continues to rotate at a predetermined constant speed. Thus, when the partially cylindrical wall 171*f* eventually reaches the agitator 28 as shown in FIG. 16D, the partially cylindrical wall 171*f* again engages the arm 28*c*, causing the agitator 28 to rotate again together with the bearing member 171*a* in the E direction from the bottom dead center as shown in FIGS. 16E and 16F.

When the agitator 28 rotates to a position where the arm 28*c* extends substantially horizontally, the agitating portion 28*a* begins to gradually leave the inner surface of the wall of the shutter 51. As the agitator 28 rotates from the bottom dead center such that the shaft portions 28*b* slowly slides on the inner surface of the wall of the bearing member 171*a* that defines the bearing hole 171*e* as shown in FIG. 16G. The agitator 28 further rotates in the E direction so that the agitating portion 28*a* rotates toward the top dead center, thus reaching to the FIG. 16A position again. For each complete rotation of the agitator 28, the positions of agitating portion 28*a* and shafts 28*b* change as shown in FIGS. 16A-16G.

When the agitating portion 28*a* drops by gravity, the agitator 28 vibrates due to impact. The rotational speed of the bearing member 171 is very low compared to the speed at which the agitating portion 28*a* drops by gravity. Thus, as shown in FIG. 16D, the vibration of the agitator 28 will have decayed by the time the bearing member 171 again pushes the agitator 28 to rotate in the E direction. The vibration of the agitator 28 causes the toner adhering to the agitator 28 to drop off the agitator 28.

The locus of the agitator 28 varies in accordance with the position of the center of gravity of the agitator 28 and various factors that satisfy equations (1) and (2). Such factors include the dimensions of various structural elements, the circumferential dimension of the partially cylindrical wall 171*f*, and the remaining amount of toner that exerts a load on the agitator 28. However, as long as equation (1) is satisfied, the agitating portion 28*a* slides on the inner surface of the wall of the shutter 51 as shown in FIGS. 16C-16F. The configuration of the aforementioned embodiment does not make the agitator 28 inoperative or cause an abnormally large load on the agitator 28. The agitating portion 28*a* slides on the inner bottom surface of the shutter 51 to agitate or discharge the toner, allowing the toner to be used up completely. When the toner cartridge 18 holds a relatively large amount of toner therein, the agitator 28 does not contact the inner surface of the wall of the shutter 51, thus not rubbing the toner against the wall more than necessary as well as preventing the toner from being deteriorated.

While the relationship between the cylindrical hollow portion 171*a* and the agitator 28 has been described with reference to FIGS. 16A-16G, the relationship is also true for the bearing portion 61 of the side wall 60 and the agitator 28. In other words, as long as equation (1) is satisfied, the agitating portion 28*a* slides on the inner wall surface of the shutter 51. Also, as long as equation (2) is satisfied, the agitator 28 is not caught tightly between the inner surface of the wall of the shutter 51 and the wall surface that defines the hole 61*a*. Thus, smooth rotation of the agitator 28 is not impaired. The components of the structural elements are not damaged. No abnormally large load is exerted on the agitator 28.

The aforementioned configuration of the second embodiment does not make the agitator 28 inoperative or cause any abnormally large load on the agitator 28 during agitation of toner. The agitating portion 28*a* slides on the lowest surface of the wall of the shutter 51 that defines the bearing hole 171*e*, agitating or discharging the toner as well as allowing the toner in the toner cartridge 18 to be used up completely. When the toner cartridge 18 holds a relatively large amount of toner therein, the agitator 28 does not contact the inner surface of the wall of the shutter 51, thus not rubbing the toner against the wall more than necessary as well as preventing the toner from being deteriorated. Little or no vibration due to impact occurs until the amount of toner remaining in the toner cartridge becomes small so that the agitator 28 drops by gravity. This decreases the chance of noise being caused.

The present invention is applicable to toner cartridges and developing units that are incorporated in facsimile machines, copying machines, and multi-function printers (MFPs). While the embodiments have been described with respect to a toner cartridge detachably attached to a developing unit, the invention may also be applied to a cartridge permanently mounted to a developing unit, a cartridge in integral construction with a developing unit, and a cartridge into which waste toner scraped off a photoconductive drum is collected by means of a waste toner transporting belt.

What is claimed is:

1. A developer holding apparatus holding developer and including a discharging opening through which the developer is discharged, the developer holding apparatus comprising:

an agitator including a shaft portion and an agitating portion;

a hollow body in which the agitator rotates; and a bearing member defining a bearing hole in which the shaft portion is rotatably and loosely received, the bearing hole including a larger diameter than the shaft portion so that a center of rotation of the shaft portion is movable within the bearing hole so as to allow said center to move towards an inner wall of the hollow body, and to further allow said center to move away from said inner wall, the bearing member driving said agitator to rotate, wherein the agitating portion rotates through a first angular range of rotation within which the discharging opening is disposed, and a second angular range of rotation, the discharging opening being disposed entirely outside of the second angular range, the agitating portion rotating through the second angular range so as to not contact an inner surface of the developer holding apparatus, further wherein when the developer is at or below a predetermined amount and the agitating portion is rotating within the first angular range, the agitating portion is in contact with said inner surface.

2. The developer holding apparatus according to claim 1, wherein the hollow body comprises:

a shutter portion having an opening; and a lever portion, wherein during operation of said lever portion, said hollow body rotates such that the opening of the shutter portion is aligned with the developer discharging opening.

3. The developer holding apparatus according to claim 1, wherein said hollow body, bearing member, and agitator are related such that $$\{(H/2)-(h/2)\}<\{L-(d/2)\} \quad (1)$$

$$\{L+(d/2)\}<\{(H/2)+(h/2)\} \quad (2)$$

where L is a largest radius of a cylindrical space described by the agitator as the agitator rotates about the shaft portion, d is a diameter of the shaft portion, H is an inner diameter of the hollow body, and h is an inner diameter of the bearing hole.

4. The developer holding apparatus according to claim 2, wherein said hollow body rotatably supports said bearing member, and includes a gear via through which a drive force is transmitted from outside of the developer holding apparatus to drive said agitator such that said agitator is driven to rotate.

5. The developer holding apparatus according to claim 1, wherein said agitator is in the shape of a crank including shaft portions that include said shaft portion about which the agitator rotates, arm portions extending away from the shaft portions, and the agitating portion is connected to the arm portions and extends substantially in a direction parallel to the shaft portions.

6. The developer holding apparatus according to claim 5, wherein said bearing member further includes a cylindrical wall the defines the bearing hole, and an abutment portion formed on the cylindrical wall, wherein said bearing member rotates relative to the hollow body and the abutment portion abuts one of the arm portions to drive said agitator to rotate together with said bearing member.

7. The developer holding apparatus according to claim 6, the abutment portion defining a cutout in which the arm portion is received.

8. The developer holding apparatus according to claim 6, wherein the abutment portion extends over an angle less than 180 degrees about the bearing hole.

9. The developer holding apparatus according to claim 7, wherein said hollow body, bearing member, and agitator are related such that $$\{(H/2)-(h/2)\}<\{L-(d/2)\} \quad (1)$$

$$\{L+(d/2)\}<\{(H/2)+(h/2)\} \quad (2)$$

where L is a largest radius of a cylindrical space described by the agitator as the agitator rotates about the shaft portion, d is a diameter of the shaft portion, H is an inner diameter of the hollow body, h is an inner diameter of the bearing hole.

10. The developer holding apparatus according to claim 8, wherein said hollow body, bearing member, and agitator are related such that $$\{(H/2)-(h/2)\}<\{L-(d/2)\} \quad (1)$$

$$\{L+(d/2)\}<\{(H/2)+(h/2)\} \quad (2)$$

where L is a largest radius of a cylindrical space described by the agitator as the agitator rotates about the shaft portion, d is a diameter of the shaft portion, H is an inner diameter of the hollow body, h is an inner diameter of the bearing hole.

11. A developing apparatus comprising a developer holding apparatus according to claim 1.

12. An image forming apparatus comprising a developing apparatus that incorporates the developer holding apparatus according to claim 1.

13. The developer holding apparatus according to claim 1, wherein when the developer is above the predetermined amount and the agitating portion is rotating within the first angular range, the agitator does not contact said inner surface.

14. The developer holding apparatus according to claim 1, wherein the developer is at or below the predetermined amount.

15. The developer holding apparatus according to claim 14, wherein the agitating portion is within the first angular range, and a first portion of the agitating portion is in contact with said inner surface while at the same time a second portion of the agitating portion is not in contact with the inner surface and is disposed above the discharging opening.

16. The developer holding apparatus according to claim 1, wherein said center moves towards said inner wall during a first movement of the agitating portion and said center moves away from said inner wall during a second movement of the agitating portion.

* * * * *